US006910395B2

(12) United States Patent
Bülow

(10) Patent No.: US 6,910,395 B2
(45) Date of Patent: Jun. 28, 2005

(54) PIPETTING DEVICE

(75) Inventor: Sven Bülow, Hamburg (DE)

(73) Assignee: Eppendorf AG, Hamburg (DE)

( * ) Notice: Subject to any disclaimer, the term of this patent is extended or adjusted under 35 U.S.C. 154(b) by 141 days.

(21) Appl. No.: 10/629,120

(22) Filed: Jul. 30, 2003

(65) Prior Publication Data

US 2004/0031334 A1 Feb. 19, 2004

(30) Foreign Application Priority Data

Aug. 17, 2002 (DE) ..... 102 37 770

(51) Int. Cl.[7] ..... B01L 3/02
(52) U.S. Cl. ..... 73/864.14; 73/864.18; 422/925
(58) Field of Search ..... 73/864.01, 864.14, 73/864.16, 864.18; 422/925

(56) References Cited

U.S. PATENT DOCUMENTS 3,343,539 A * 9/1967 Moorhouse ..... 604/211
3,827,305 A * 8/1974 Gilson et al. ..... 73/864.18

FOREIGN PATENT DOCUMENTS

DE 25 49 477 12/1977
EP 0 286 676 10/1988

* cited by examiner

*Primary Examiner*—Hezron Williams
*Assistant Examiner*—Tamiko Bellamy
(74) *Attorney, Agent, or Firm*—Vidas, Arrett & Steinkraus, P.A.

(57) ABSTRACT

A pipetting device for detachably mountable pipette tips, comprising a moving device, a piston movable by the moving device in a cylinder to displace a column of air, an attachment stem for mounting a pipette tip, with an aperture having a connection to the cylinder at the free end, two stops limiting the movement of the piston during the displacement of the column of air, one of which is dislocatable, a precise adjustment device for dislocating the dislocatable stop in parallel with the piston for a precise adjustment of the piston stroke, a coupling device which puts the precise adjustment device into function, when coupled, and puts it out of function, when uncoupled, a rough adjustment device for dislocating the dislocatable stop when the precise adjustment device is uncoupled, for a rough adjustment of the piston stroke, and a measuring and indicating device coupled to the dislocatable stop for measuring the position set for the dislocatable stop and indicating the proportioning volume that matches the piston stroke set.

10 Claims, 2 Drawing Sheets

PIPETTING DEVICE

CROSS-REFERENCE TO RELATED APPLCIATIONS

Not Applicable.

STATEMENT REGARDING FEDERALLY SPONSORED RESEARCH

Not Applicable.

BACKGROUND OF THE INVENTION

Pipetting devices are primarily used at laboratories to proportion liquid volumes. They have a moving device by means of which a piston is movable within a cylinder to displace a column of air. The cylinder is connected to the aperture of an attachment stem onto which a pipette tip can be detachably placed. The movement of the piston by means of the moving device permits to displace the column of air to suck a liquid sample into or expel from the pipette tip. The proportioning volume, i.e. the volume of the liquid sample, is defined by the stroke of the piston that is limited by a stop.

Adjustable pipetting devices have an adjustment device to shift the stop. The stop is frequently arranged within a spindle which is passed through by a piston rod of the piston. The piston rod has a counter-stop which interacts with the stop. The position of the stop and, thus, the piston stroke and the proportioning volume are adjustable by displacing the spindle in a spindle nut.

DE 25 49 477 C3 discloses an adjustable pipetting device of the aforementioned type in which the movement of the piston is limited by a stop joined to the spindle. If a passage is intended from a setting effected at one end of the range of adjustment over to a setting to be effected at the other end numerous rotations require to be made on the spindle or the setting knob joined to the upper end thereof. This needs a lot of time and is very troublesome.

EP 0 286 676 has made known a pipette with a rapidly variable pro-portioning volume. It has a casing in which a piston with a piston rod is movably arranged. The extent of piston stroke and, thus, the extent of proportioning is adjusted by a regulation bushing which is permanently coupled to a device for the visual read-out of the proportioning volume. This device serves for a rough adjustment. The position of the regulation bushing is set by rotating an adjusting nut which has a female thread meshing with the regulation bushing and can be rotated from the side of the casing. The adjusting nut carries an indication mark at the outer circumference to read its precise adjustment. The engagement of the adjusting nut with the thread of the regulation bushing can be cancelled by laterally forcing the adjusting nut inwardly against a resilient force. Then, the regulation bushing will be displaceable when a push-button of the piston rod is actuated, in which operation a transmission of forces takes lace via springs between the regulation bushing and the piston rod. The adjusting nut is coupled again after such rough adjustment, which can be read from the device for the visual read-out of the proportioning volume, after which a another, precise adjustment can be made, if required.

The indication devices are very expensive in this device and precise read-outs and adjustments are difficult.

BRIEF SUMMARY OF THE INVENTION

Accordingly, it is the object of the invention to provide an adjustable pipetting device with a fast adjusting mechanism that is more comfortable in use.

Advantageous aspects of the pipetting device are indicated in the sub-claims.

The inventive pipetting device for detachably mountable pipette tips has moving device; a piston movable by the moving device in a cylinder to displace a column of air; an attachment stem for mounting a pipette tip, with an aperture having a connection to the cylinder at the free end; two stops limiting the movement of the piston during the displacement of the column of air, one of which is dislocatable; a precise adjustment device for dislocating the dislocatable stop in parallel with the piston for a precise adjustment of the piston stroke; a coupling device which puts the precise adjustment device into function, when coupled, and puts it out of function, when uncoupled; a rough adjustment device for dislocating the dislocatable stop when the precise adjustment device is uncoupled, for a rough adjustment of the piston stroke, and a measuring and indicating device coupled to the dislocatable stop for measuring the position set for the dislocatable stop and indicating the proportioning volume that matches the piston stroke set.

Since the measuring and indicating device is coupled to the displaceable stop the device always measures and indicates the setting of the displaceable stop. Hence, the precise setting of the displaceable stop can always be read accurately during the precise adjustment and rough adjustment by means of a single indicating device. Thus, the proportioning volume desired can be adjusted rapidly, easily, and accurately. This significantly enhances the comfort in using the pipetting device.

The displaceable stop can be a stop which limits the movement of the piston away from the attachment stem (upper stop) or towards the attachment stem (lower stop). Preferably, the displaceable stop is the upper stop. It is preferred that the other stop be fixed.

According to an aspect, the dislocatable stop is adjustable by means of a spindle which is threadable into a spindle nut with the coupling device, when coupled, causing the spindle nut to engage the spindle and, when uncoupled, cancels the engagement or, when coupled, causes the spindle nut to be supported in the axial direction of the piston and, when uncoupled, cancels the support. This allows to provide for an accurate precise adjustment and a fast rough adjustment in a simple manner. The spindle merely needs to be displaced axially for a rough adjustment.

According to an aspect, the dislocatable stop is disposed within the spindle which is passed through by a piston rod of the piston that has a counter-stop which strikes the dislocatable stop at one end of the piston stroke. In this construction, the rough adjustment of the spindle may be caused by an actuation of the piston. To this end, according to an aspect, the piston rod is supported on the spindle via springs. Accordingly, the construction can be realized to the extent disclosed in DE 25 49 477 C3 which is incorporated here by reference thereto.

According to an aspect, the spindle is laterally disposed next to a piston rod of the piston and has a laterally projecting, dislocatable stop which strikes a counter-stop of the piston rod of the piston at one end of the piston stroke. This favors a different arrangement of the control and indicating devices which can be advantageous ergonomically.

According to an aspect, the dislocatable stop laterally projects from a toothed rack which is disposed in parallel with a piston rod of the piston that meshes with a gear for the precise adjustment of the toothed rack with the coupling device, when coupled, causing the gear to engage the toothed rack and, when uncoupled, cancels the engagement or, when coupled, causes the bearing of the gear to be supported in the axial direction of the piston and, when uncoupled, cancels the support. This provides an alternative to a spindle arrangement.

According to an aspect, a rotary knob for a precise adjustment of the piston stroke is connected to the spindle or the gear. When connected to the spindle, the rotary knob will preferably project at top from a casing of the pipetting device.

According to an aspect, the coupling device is formed as a non-positive or positive or electromagnetic clutch device. A non-positive coupling device, in particular, may be designed as a spindle nut which is divided in halves and may be pulled apart perpendicularly to the plane of division to release the, spindle. A positive coupling device may be designed in the fashion of brake shoes which act on a spindle from a side. An electromagnetic clutch device may have electromagnetic clutch components one of which is joined to the spindle and another of which is arranged at its side.

According to an aspect, the coupling device is operable by means of spring-loaded control button.

The measuring and indicating device may be designed as a mechanical measuring and indicating device, e.g. a gearing coupled to the stop and a counter mechanism coupled thereto. However, it can also be formed as an electronic or opto-electronic path-measuring and indicating device. For example, it can be a graduated scale coupled to the stop which is scanned by an opto-electronic device.

It is understood that all of the aforementioned constituents of a pipetting device are arranged in or on a casing.

The invention will now be described in more detail below with reference to the accompanying drawings of embodiments.

FIG. 1(*b*) is a cross sectional view of the invention after rough adjustment;

FIG. 1(*c*) is a cross sectional view of the invention after precise adjustment;

FIG. 1(*d*) is an enlarged partial section through the lower portion of FIG. 1(*c*)

DETAILED DESCRIPTION OF THE INVENTION

While this invention may be embodied in many different forms, there are described in detail herein a specific preferred embodiment of the invention. This description is an exemplification of the principles of the invention and is not intended to limit the invention to the particular embodiment illustrated.

Figures 1A, 1B, 1C:
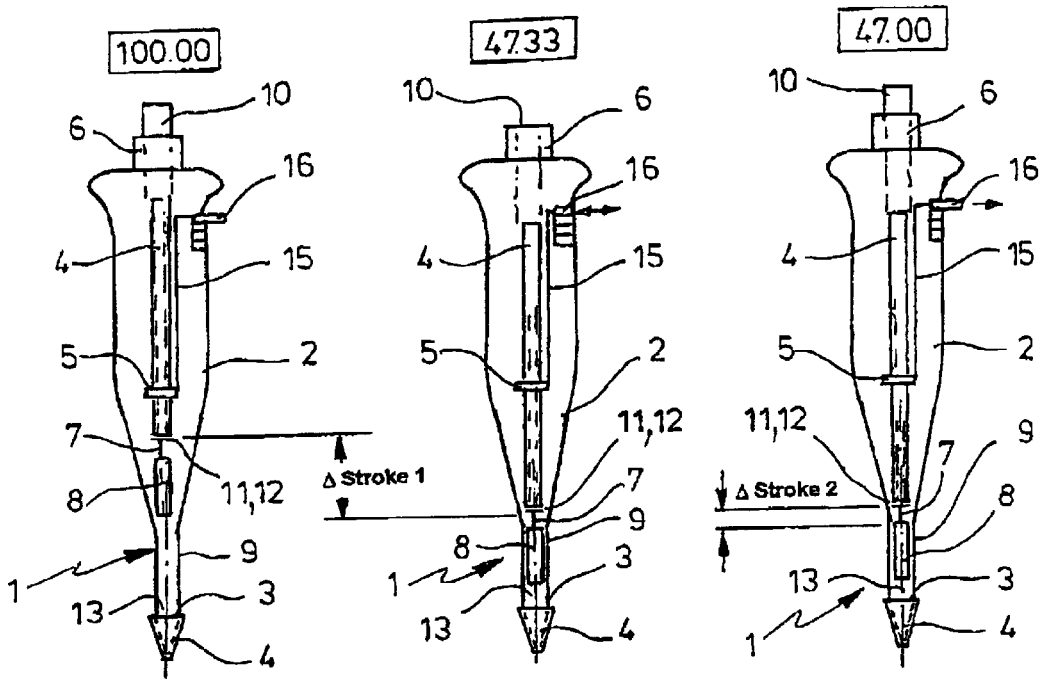
FIG. 1(*a*) is a cross sectional view of the invention in an unadjusted state.
Figure 1D:
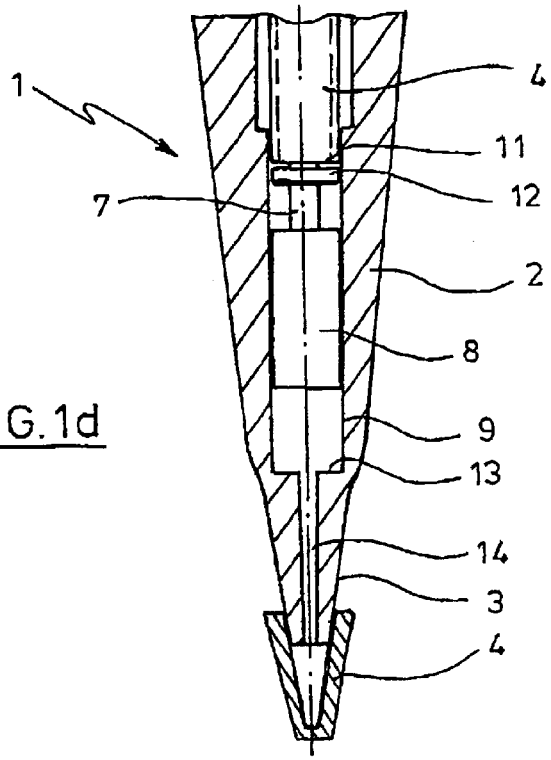
Figure 2:
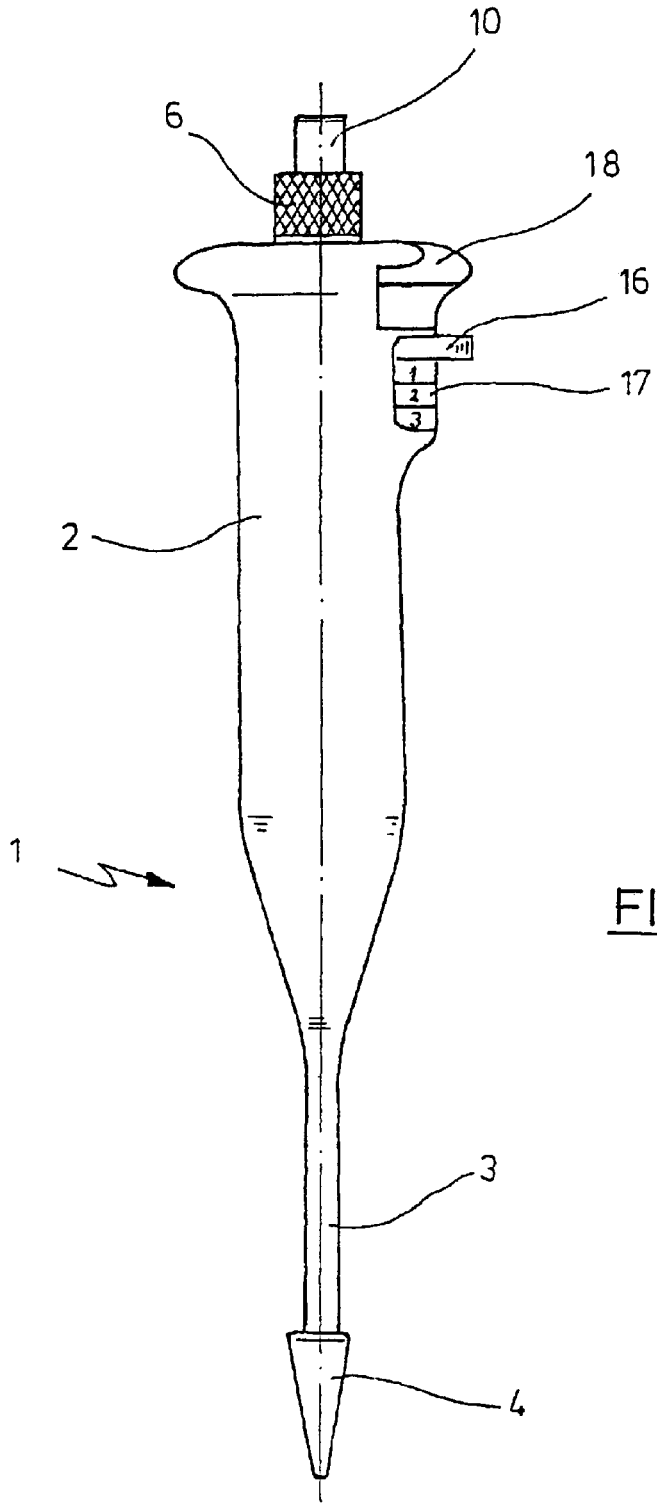
FIG. 2. is a front view of the invention shown in FIG. 1(*a*).

FIGS. 1(*a*) to (*d*) show a pipetting device with a spindle and a spindle nut adapted to be coupled in an upper adjustment of the spindle (FIG. 1*a*), a lower adjustment of the spindle after it was locked in place and underwent rough adjustment (FIG. 1*b*) and following its subsequent precise adjustment after it was re-locked in place, in a roughly schematic perspective X-ray type image each and in the condition of FIG. 1*c* in an enlarged partial section through its lower portion (FIG. 1*d*);

FIG. 2 shows a pipetting device with a control knob for actuating the coupling devices in a schematic side view.

Referring to FIG. 1, a hand-operated pipette 1 has a pipette casing 2 which is of a slightly conical shape towards the lower end and has an attachment stem 3 there. The attachment stem 3 has detachably mounted thereon a pipette tip 4.

Arranged on the upper region of the pipette casing 2 is a spindle 4 which meshes with a spindle nut 5 that is also arranged in the casing 2.

A rotary knob 6 which projects at top from the casing 2 is joined to the upper end of the spindle 4.

The spindle 4 is passed through by a piston rod 7 of a piston 8 which is disposed in a cylinder 9 which is joined to an aperture at the lower end of the attachment stem 3.

The piston rod 7 is joined to a push-button 10 at top. The button projects from the rotary knob 6, when not actuated, and will be pressed deeper into the rotary knob, when actuated. Basically, it is also possible to form the rotary knob 6 and push-button 10 as an integral unit.

A displaceable stop 11 is defined by the lower end face of the spindle 4. The stop interacts with a counter-stop 12 on the piston rod 7. This limits the stroke of the piston 8 away from the attachment stem 3. The lower limiting wall of the cylinder 9 defines a fixed lower stop 13. This limits the piston stroke towards the attachment stem 3. The connection 14 leading to the aperture at the lower end of the attachment stem runs into the lower limiting wall.

The spindle nut 5 can be brought into engagement and out of engagement with the spindle 4 by means of the coupling device 15. To this end, the coupling device 15 is operable via a spring-loaded control button 16 which laterally projects at top from the pipette casing 2.

According to FIG. 1*a*, the spindle 4 is in an upper position. The coupling de-vice 15 is engaged and the spindle nut 5 meshes with the spindle 4. This makes possible a relatively large proportioning volume which is indicated as 100 ml in the drawing.

Referring to FIG. 1*b*, the spindle nut 5 is disengaged by means of the coupling device 15 and a rough adjustment is made to achieve a proportioning volume of 47.33 ml by an actuation of the push-button 10. The force applied to the push-button 10 is transmitted to the spindle 4 via a restoring spring which is not shown. At this point, the piston 8 travels through the distance which is in between FIGS. 1*a* and 1*b* and is designated as Δ Stroke 1.

Referring to FIG. 1*c*, the spindle nut 5 is caused to engage the spindle again by releasing the coupling device 15. The rotary knob 6 is rotated afterwards, which effects a precise adjustment to a proportioning volume of 47.00 ml which is drawn in between FIGS. 1*b* and 1*c* and is designated as Δ Stroke 2.

Subsequently, the push-button 10 is pressed in and released, which causes a piston stroke limited by the stops 11, 13, the respective air volume is expelled, and a proportioning volume is sucked into the pipette tip 4.

The read-out device is not shown in detail in FIG. 1. The device preferably is an electro-optical measuring and read-out device which engages the stop 5.

In the embodiment of FIG. 2, the elements identical to those of the embodiment of FIG. 1 are designated by identical reference numbers. The above explanations will apply in this case.

A digital display from which the proportioning volume can be read is additionally disposed at the side of the casing 2 directly next to the spring-loaded control button 16.

In addition, there is an ejector head 18 at the same side of the casing 2. The pipette tip 4 can be detached from the attachment stem 3 by an actuation of the ejector head 18.

The above Examples and disclosure are intended to be illustrative and not exhaustive. These examples and description will suggest many variations and alternatives to one of ordinary skill in this art. All these alternative and variations are intended to be included within the scope of the attached claims. Those familiar with the art may recognize other equivalents to the specific embodiments described herein which equivalents are also intended to be encompassed by the claims attached hereto.

What is claimed is:

1. A pipetting device for detachably mountable pipette tips, comprising:

a moving device (7)

a piston (8) movable by the moving device (7) in a cylinder (9) to displace a column of air, an attachment stem (3) for mounting a pipette tip (4), with an aperture having a connection (14) to the cylinder (9) at the free end, two stops (11, 13) limiting the movement of the piston (8) during the displacement of the column of air, one of which is dislocatable, a precise adjustment device (6) for dislocating the dislocatable stop (11) in parallel with the piston (8) for a precise adjustment of the piston stroke, a coupling device (15) which puts the precise adjustment device (6) into function, when coupled, and puts it out of function, when uncoupled, a rough adjustment device (10) for dislocating the dislocatable stop (11) when the precise adjustment device (6) is uncoupled, for a rough adjustment of the piston stroke, and a measuring and indicating device (17) coupled to the dislocatable stop (11) for measuring the position set for the dislocatable stop (11) and indicating the proportioning volume that matches the piston stroke set.

2. The pipetting device as claimed in claim 1 wherein the dislocatable stop (11) is adjustable by means of a spindle (4) which is threadable into a spindle nut (5) with the coupling device (15), when coupled, causing the spindle nut (5) to engage the spindle and, when uncoupled, cancels the engagement or, when coupled, causes the spindle nut (5) to be supported in the axial direction of the piston (8) and, when uncoupled, cancels the support.

3. The pipetting device as claimed in claim 2 wherein the dislocatable stop (11) is disposed within the spindle which is passed through by a piston rod (7) of the piston (8) that has a counter-stop (12) which strikes the dislocatable stop (11) at one end of the piston stroke.

4. The pipetting device as claimed in claim 2 wherein the spindle (4) is laterally disposed next to a piston rod (7) of the piston (8) and has a laterally projecting, dislocatable stop (11) which strikes a counter-stop of the piston rod of the piston (8) at one end of the piston stroke.

5. The pipetting device as claimed in claim 1 wherein the dislocatable stop (11) laterally projects from a toothed rack which is disposed in parallel with a piston rod (7) of the piston (8) that meshes with a gear for the precise adjustment of the toothed rack with the coupling device, when coupled, causing the gear to engage the toothed rack and, when uncoupled, cancels the engagement or, when coupled, causes the bearing of the gear to be supported in the axial direction of the piston (8) and, when uncoupled, cancels the support.

6. The pipetting device as claimed in claim 2 wherein a rotary knob (6) for a precise adjustment of the piston stroke is connected to the spindle (4) or the gear.

7. The pipetting device as claimed in claim 1 wherein the coupling device (15) is formed as a non-positive or positive or electromagnetic clutch device.

8. The pipetting device as claimed in claim 1 wherein a piston rod (7) of the piston (8) is operable by means of spring-loaded push-button (10).

9. The pipetting device as claimed in claim 1 wherein the coupling device (15) is operable by means of spring-loaded control button (16).

10. The pipetting device as claimed in claim 1 wherein the measuring and indicating device is a mechanical and/or electronic and/or opto-electronic measuring and indicating device (17).

* * * * *